US011619127B1

(12) United States Patent
AlTammar et al.

(10) Patent No.: US 11,619,127 B1
(45) Date of Patent: Apr. 4, 2023

(54) WELLHEAD ACOUSTIC INSULATION TO MONITOR HYDRAULIC FRACTURING

(71) Applicant: Saudi Arabian Oil Company, Dhahran (SA)

(72) Inventors: Murtadha J. AlTammar, Dhahran (SA); Misfer J. Almarri, Dhahran (SA); Khalid Mohammed M. Alruwaili, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/543,508

(22) Filed: Dec. 6, 2021

(51) Int. Cl.

| | |
|---|---|
| ***E21B 47/14*** | (2006.01) |
| ***E21B 43/26*** | (2006.01) |
| ***E21B 33/03*** | (2006.01) |
| ***E21B 34/06*** | (2006.01) |

(52) U.S. Cl.
CPC ..... *E21B 47/14* (2013.01); *E21B 33/03* (2013.01); *E21B 34/06* (2013.01); *E21B 43/2607* (2020.05); *E21B 2200/06* (2020.05)

(58) Field of Classification Search
CPC ..... E21B 47/14; E21B 43/26; E21B 43/2607; E21B 33/03
See application file for complete search history.

(56) References Cited

U.S. PATENT DOCUMENTS

| | | | |
|---|---|---|---|
| 2,688,369 | A | 9/1954 | Broyles |
| 2,699,212 | A | 1/1955 | Dismukes |
| 2,758,653 | A | 8/1956 | Desbrow |
| 3,050,122 | A | 8/1962 | Huitt et al. |
| 3,118,501 | A | 1/1964 | Kenley |
| 3,211,221 | A | 10/1965 | Huitt |
| 3,254,720 | A | 8/1966 | Huitt |
| 3,313,348 | A | 4/1967 | Huitt et al. |

(Continued)

FOREIGN PATENT DOCUMENTS

| | | |
|---|---|---|
| CN | 101726223 | 6/2010 |
| EA | 004186 | 2/2004 |

(Continued)

OTHER PUBLICATIONS

Abad et al., "Evaluation of the Material Properties of the Multilayered Oxides formed on HCM12A using New and Novel Techniques," Manuscript No. OX1D-D-15-00019, Manuscript Draft, 2015, 44 pages.

(Continued)

*Primary Examiner* — Shane Bomar
(74) *Attorney, Agent, or Firm* — Fish & Richardson P.C.

(57) ABSTRACT

To monitor hydraulic fracturing operations, an acoustic insulation tool acoustically insulates a wellhead installed at a surface of a wellbore. Multiple acoustic sensors attached to the wellhead sense acoustic signals generated responsive to operation of hydraulic fracturing components. The components perform hydraulic fracturing operations within the wellbore. The acoustic insulation tool acoustically insulates the wellhead from acoustic signals generated by sources other than the hydraulic fracturing components. The multiple acoustic sensors transmit the sensed acoustic signals to a computer system. Using the received acoustic signals, the computer system monitors the hydraulic fracturing operations performed within the wellbore.

16 Claims, 4 Drawing Sheets

(56) References Cited

U.S. PATENT DOCUMENTS 3,331,439 A 7/1967 Lawrence
4,149,409 A 4/1979 Serata
4,220,550 A 9/1980 Frenier et al.
4,262,745 A 4/1981 Stewart
4,289,639 A 9/1981 Buske
4,381,950 A 5/1983 Lawson
4,390,067 A 6/1983 Willman
4,629,702 A 12/1986 Fan et al.
4,662,440 A 5/1987 Harmon
4,683,950 A 8/1987 Lessi
4,687,061 A 8/1987 Uhri
4,754,808 A 7/1988 Harmon
4,809,793 A 3/1989 Hailey
4,974,675 A 12/1990 Austin et al.
5,016,710 A 5/1991 Renard
5,060,738 A 10/1991 Pittard et al.
5,074,360 A 12/1991 Guinn
5,111,881 A 5/1992 Soliman et al.
5,228,510 A 7/1993 Jennings, Jr.
5,251,286 A 10/1993 Wiener et al.
5,277,062 A 1/1994 Blauch et al.
5,450,902 A 9/1995 Matthews
5,517,854 A 5/1996 Plumb et al.
5,735,359 A 4/1998 Lee et al.
5,999,887 A 12/1999 Giannakopoulos et al.
6,095,244 A 8/2000 Graham
6,119,776 A 9/2000 Graham et al.
6,140,816 A 10/2000 Heron et al.
6,283,214 B1 9/2001 Guinot
6,425,448 B1 7/2002 Zupanick
6,488,087 B2 12/2002 Longbottom
6,516,080 B1 2/2003 Nur
6,694,262 B2 2/2004 Rozak
6,729,394 B1 5/2004 Hassan
6,832,158 B2 12/2004 Mese et al.
6,843,233 B2 1/2005 Berger et al.
6,866,048 B2 3/2005 Mattox
7,188,058 B2 3/2007 Hardy
7,369,980 B2 5/2008 Deffenbaugh et al.
7,370,696 B2 5/2008 Al-Muraikhi
7,419,005 B2 9/2008 Al-Muraikhi
7,472,748 B2 1/2009 Gdanski et al.
7,637,316 B2 12/2009 Best
7,828,063 B2 11/2010 Olsen et al.
8,024,124 B2 9/2011 Sayers
8,041,510 B2 10/2011 Dasgupta
8,081,802 B2 12/2011 Dvorkin et al.
8,265,915 B2 9/2012 Hsu et al.
8,380,437 B2 2/2013 Abousleiman et al.
8,490,685 B2 7/2013 Tolman
8,606,524 B2 12/2013 Soliman et al.
8,614,573 B2 12/2013 Minh
8,619,500 B2 12/2013 Gray et al.
8,631,872 B2 1/2014 East
8,731,889 B2 5/2014 Du et al.
8,868,385 B2 10/2014 Fertig et al.
8,967,249 B2 3/2015 Akkurt et al.
9,046,509 B2 6/2015 Dvorkin et al.
9,063,252 B2 6/2015 Kamal
9,097,818 B2 8/2015 Hursan
9,187,992 B2 11/2015 Cherian
9,587,649 B2 3/2017 Oehring
9,739,905 B2 8/2017 Sena
9,784,085 B2 10/2017 Liu et al.
9,822,639 B2 11/2017 Jandhyala
10,351,758 B2 7/2019 Hull et al.
10,415,367 B2 9/2019 Galford
10,458,334 B2 * 10/2019 Davis ..... F02C 6/00
10,612,355 B1 4/2020 Alruwaili et al.
10,741,158 B1 8/2020 Aune
10,920,554 B2 2/2021 Alruwaili et al.
11,035,212 B2 6/2021 Alruwaili et al.
11,078,770 B2 8/2021 Alruwaili et al.
11,143,578 B2 10/2021 Alruwaili et al.
2003/0171879 A1 9/2003 Pittalwala
2003/0173081 A1 9/2003 Vinegar
2003/0173082 A1 9/2003 Vinegar
2003/0192693 A1 10/2003 Wellington
2004/0020642 A1 2/2004 Vinegar
2005/0060130 A1 3/2005 Shapiro et al.
2007/0051517 A1 3/2007 Suijaatmadja et al.
2007/0203677 A1 8/2007 Awwiller
2008/0179060 A1 7/2008 Suijaatmadja et al.
2008/0264640 A1 10/2008 Eslinger
2009/0193881 A1 8/2009 Finnberg
2009/0266548 A1 10/2009 Olsen et al.
2010/0128982 A1 5/2010 Dvorkin et al.
2010/0186520 A1 7/2010 Wheeler
2010/0213579 A1 8/2010 Henry
2010/0230093 A1 * 9/2010 Knudsen ..... E21B 47/14 181/207
2010/0279136 A1 11/2010 Bonucci
2011/0017458 A1 1/2011 East et al.
2011/0067870 A1 3/2011 East
2011/0284214 A1 11/2011 Ayoub et al.
2012/0150515 A1 6/2012 Hariharan et al.
2013/0032349 A1 2/2013 Alekseenko et al.
2013/0199787 A1 8/2013 Dale et al.
2013/0248192 A1 9/2013 Cook
2013/0336612 A1 12/2013 Pearce
2014/0039797 A1 2/2014 Gonzales
2014/0048694 A1 2/2014 Pomerantz
2014/0069653 A1 3/2014 Liu et al.
2014/0078288 A1 3/2014 Wu
2014/0214326 A1 7/2014 Samuel
2014/0352968 A1 12/2014 Pitcher
2015/0096806 A1 4/2015 Fonseca Ocampos
2015/0136388 A1 5/2015 Fehr et al.
2015/0176362 A1 6/2015 Hariharan et al.
2015/0198038 A1 7/2015 Bartetzko
2015/0293256 A1 10/2015 Dusterhoft
2016/0201440 A1 7/2016 Aidagulov
2016/0203239 A1 7/2016 Samuel et al.
2016/0208592 A1 * 7/2016 Oehring ..... E21B 43/2607
2017/0030188 A1 2/2017 Lehr
2017/0067836 A1 3/2017 Hull et al.
2017/0176639 A1 6/2017 Mosse et al.
2017/0248011 A1 8/2017 Craddock et al.
2017/0260848 A1 9/2017 Xia
2018/0087350 A1 3/2018 Sherman
2018/0094519 A1 4/2018 Stephens
2018/0119533 A1 5/2018 Alhuthali
2018/0119535 A1 5/2018 Shen et al.
2018/0179881 A1 6/2018 Thompson
2018/0196005 A1 7/2018 Fanini
2018/0266183 A1 9/2018 Ayub
2018/0274312 A1 9/2018 Zhou
2018/0321416 A1 11/2018 Freedman
2018/0334903 A1 11/2018 Lehr et al.
2018/0371882 A1 12/2018 Delange
2018/0371903 A1 12/2018 Li et al.
2019/0068026 A1 * 2/2019 Davis ..... F02B 63/044
2019/0112912 A1 4/2019 Thompson et al.
2019/0195043 A1 6/2019 Singh
2019/0218907 A1 7/2019 Ow
2019/0226956 A1 7/2019 Alruwaili et al.
2019/0257179 A1 8/2019 Assaad
2019/0257187 A1 8/2019 Aljubran
2019/0257729 A1 8/2019 Han
2020/0011169 A1 1/2020 Haghshenas
2020/0024935 A1 1/2020 Eitschberger et al.
2020/0024936 A1 1/2020 Chang
2020/0072044 A1 * 3/2020 Zhang ..... E21B 49/00
2020/0095855 A1 3/2020 Hughes
2020/0378246 A1 12/2020 Rodrigues
2021/0054735 A1 2/2021 Almwaili
2021/0172315 A1 6/2021 Almwaili
2021/0286096 A1 * 9/2021 Jin ..... G01V 1/38
2021/0293127 A1 * 9/2021 Donderici ..... E21B 47/013

(56) References Cited

U.S. PATENT DOCUMENTS

| | | | |
|---|---|---|---|
| 2021/0332686 | A1 | 10/2021 | Safariforoshani |
| 2021/0406426 | A1 | 12/2021 | Han et al. |

FOREIGN PATENT DOCUMENTS

| | | |
|---|---|---|
| EP | 0460927 | 2/1993 |
| EP | 0474350 | 9/1994 |
| RU | 2211318 | 8/2003 |
| SU | 1036926 | 8/1983 |
| SU | 1680925 | 9/1991 |
| SU | 1709055 | 1/1992 |
| WO | WO 2009001069 | 12/2008 |
| WO | WO 2010008684 | 1/2010 |
| WO | WO 2010074581 | 7/2010 |
| WO | WO 2010083166 | 7/2010 |
| WO | WO 2013186569 | 12/2013 |
| WO | WO 2014116305 | 7/2014 |
| WO | WO 2014178504 | 11/2014 |
| WO | WO 2016094153 | 6/2016 |
| WO | WO 2017065331 | 4/2017 |
| WO | WO 2017078674 | 5/2017 |
| WO | WO 2017106724 | 6/2017 |
| WO | WO 2018174987 | 9/2018 |
| WO | WO 2018175394 | 9/2018 |
| WO | WO 2019064041 | 4/2019 |

OTHER PUBLICATIONS

Abousleiman et al., "A Micromechanically Consistent Poroviscoelasticity Theory for Rock Mechanics Applications," International Journal of Rock Mechanics and Mining Services & Geomechanics, Abstracts, 1993, 30:7 (1177-1180), 4 pages.

Abousleiman et al., "Anisotropic Porothermoelastic Solution and Hydro-Thermal Effects on Fracture Width in Hydraulic Fracturing," International Journal for Numerical and Analytical Methods in Geomechanics, 2013, 25 pages.

Abousleiman et al., "GeoGenome Industry Consortium (G2IC)," JIP, 2004-2006, 6 pages.

Abousleiman et al., "Geomechanics Field and Laboratory Characterization of Woodford Shale: The Next Gas Play," SPE 110120, Society of Petroleum Engineers (SPE), presented at the 2007 SPE Annual Technical Conference and Exhibition on Nov. 11-14, 2007, 14 pages.

Abousleiman et al., "Geomechanics Field Characterization of the Two Prolific U.S. Mid-West Gas Plays with Advanced Wire-Line Logging Tools," SPE 124428, Society of Petroleum Engineers (SPE), presented at 2009 SPE Annual Technical Conference and Exhibition, Oct. 4-7, 2009, 19 pages.

Abousleiman et al., "Mandel's Problem Revisited," Geotechnique, 1996, 46:2 (187-195), 9 pages.

Abousleiman et al., "Mechanical Characterization of Small Shale Samples subjected to Fluid Exposure using the Inclined Direct Shear Testing Device," International Journal of Rock Mechanics and Mining Sciences, 2010, 47:3 (355-367), 13 pages.

Abousleiman et al., "Poroelastic Solutions in Transversely Isotropic Media for Wellbore and Cylinder," PPI: S0020-7683(98)00101-2, International Journal of Solids Structures, 1998, 35:34-35 (4905-4929), 25 pages.

Abousleiman et al., "Poroviscoelastic Analysis of Borehole and Cylinder Problems," ACTA Mechanica, 1996, 119: 199-219, 21 pages.

Abousleiman et al., "The Granular and Polymer Nature of Kerogen Rich Shale," Acta Geotechnica, Feb. 2016, 24 pages.

Aidagulov et al., "Model of Hydraulic Fracture Initiation from the Notched Open hole," SPE-178027-MS, Society of Petroleum Engineers (SPE), presented at the SPE Saudi Arabia Section Annual Technical Symposium and Exhibition, Apr. 21-23, 2015, 13 pages.

Aidagulov et al., "Notching as a New Promising Well Intervention Technique to Control Hydraulic Fracturing in Horizontal Open Holes," AAPG Datapages/Search and Discovery Article #90254, American Association of Petroleum Geologists (AAPG), presented at the 12th Middle East Geosciences Conference and Exhibition GEO-2016, Mar. 7-10, 2016.

alibaba.com [online], "API 6A wellhead flange Adapter Spool Casing Spool," available on or before 2021, retrieved on Oct. 19, 2021, retrieved from URL <https://www.alibaba.com/product-detail/API-6A-wellhead-flange-Adapter-Spool_62086814814.html>, 5 pages.

Allan et al., "A Multiscale Methodology for the Analysis of Velocity Anisotropy in Organic-Rich Shale," Geophysics, Jul.-Aug. 2015, 80:4 (C73-C88), 16 pages.

Al-Qahtani et al., "A Semi-Analytical Model for Extended-Reach Wells with Wellbore Flow Splitting; a Production Optimization Scheme," SPE-177931, Society of Petroleum Engineers (SPE), presented at the Abu Dhabi International Petroleum Exhibition and Conference, Nov. 9-12, 2015, 21 pages.

Al-Yami et al., "Engineered Fit-for-Purpose Cement System to Withstand Life-of-the-Well Pressure and Temperature Cycling," SPE-188488-MS, Society of Petroleum Engineers (SPE), presented at the Abu Dhabi International Petroleum Exhibition & Conference, Nov. 2017, 14 pages.

Ananthan et al., "Influence of Strain Softening on the Fracture of Plain Concrete Beams," International Journal of Fracture, 1990, 45: 195-219, 25 pages.

Apageo.com [online], "Ménard Pressuremeter Pressuremeter test according," 2016, retrieved on Oct. 7, 2019, retrieved from URL <https://www.apageo.com/en/3/products%2Cpressuremeter-tests%2Cmenard-pressuremeter%2C14%2C5.html>, 2 pages.

Arns et al., "Computation of linear elastic properties from microtomographic images: Methodology and agreement between theory and experiment," Geophysics, Sep.-Oct. 2002, 67:5 (1396-1405), 10 pages.

Azizi et al., "Design of Deep Foundations Using the Pressuremeter Method," Proceedings of the Sixth International Offshore and Polar Engineering Conference, Los Angeles, May 1996, The International Offshore and Polar Engineers, 1, 9 pages.

Ballice, "Solvent Swelling Studies of Goynuk (Kerogen Type-I) and Beypazari Oil Shales (Kerogen Type-II)," Science Direct, Fuel, 2003, 82: 1317-1321, 5 pages.

Barton et al., "In-situ stress orientation and magnitude at the Fenton Geothermal Site, New Mexico, determined from wellbore breakouts," Geophysical Research Letters, May 1988, 15(5):467-470, 4 pages.

Bazant et al., "Deformation of Progressively Cracking Reinforced Concrete Beams," Title No. 81-26, ACI Journal, Technical Paper, May-Jun. 1984, 81:3, 11 pages.

Bazant et al., "Strain-Softening Bar and Beam: Exact Non-Local Solution," International Journal of Solids Structures, 1988, 24:7 (659-673), 15 pages.

Benafan et al., "Shape Memory Alloy Rock Splitters (SMARS)—A Non-Explosive Method for Fracturing Planetary Rocklike Materials and Minerals," NASA/TM—2015-218832, NASA STI Program, Jul. 2015, 42 pages.

Bennett et al., "Instrumented Nanoindentation and 3D Mechanistic Modeling of a Shale at Multiple Scales," Acta Geotechnica, Jan. 2015, 10:21, 14 pages.

Berger et al., "Effect of eccentricity, voids, cement channels, and pore pressure decline on collapse resistance of casing," SPE-90045-MS, Society of Petroleum Engineers (SPE), presented at the SPE Annual Technical Conference and Exhibition, Sep. 26-29, 2004, 8 pages.

Bhandari et al., "Two-Dimensional DEM Analysis of Behavior of Geogrid-Reinforced Uniform Granular Bases under a Vertical Cyclic Load," Acta Geotechnica 10:469-480, 2014, 12 pages.

Biot, "General Theory of Three-Dimensional Consolidation," The Ernest Kempton Adams Fund for Physical Research of Columbia University, Reprint Series, Journal of Applied Physics, Feb. 1941, 12:2, 11 pages.

Bobko et al., "The Nanogranular Origin of Friction and Cohesion in Shale—A Strength Homogenization Approach to Interpretation of Nanoindentation Results," International Journal for Numerical Analytical Method in Geomechanics, 2010, 23 pages.

Boskey et al., "Perspective—Collagen and Bone Strength," Journal of Bone and Mineral Research, 1999, 14:3, 6 pages.

(56) References Cited

OTHER PUBLICATIONS

Bourbie and Zinszner, "Hydraulic and Acoustic Properties as a Function of Porosity in Fontainebleau Sandstone," Journal of Geophysical Research, 90:B13 (11524-11532), Nov. 1985, 9 pages.
Cai et al., "Experimental Investigation on Perforation of Shale with Ultra-High Pressure Abrasive Water Jet: Spake, Mechanism and Sensitivity," Journal of Natural Gas Science and Engineering, Jul. 2019, 67: 196-213, 18 pages.
Chang et al., "Multiple Fracture Initiation in Openhole without Mechanical Isolation: First Step to Fulfill an Ambition," SPE 168638, Society of Petroleum Engineers (SPE), presented at the SPE Hydraulic Fracturing Technology Conference, Feb. 4-6, 2014, 18 pages.
Chen et al., "Size Effect in Micro-Scale Cantilever Beam Bending, "Acta Mech., 2011, 219: 291-307, 17 pages.
Chern et al., "Deformation of Progressively Cracking Partially Prestressed Concrete Beams," PCI Journal, Jan.-Feb. 1992, 37:1, 11 pages.
Chupin et al., "Finite Strain Analysis of Nonuniform Deformation Inside Shear Bands in Sands," International Journal for Numerical and Analytical Methods in Geomechanics, 2012, 36: 1651-1666, 16 pages.
Cui et al., "Poroelastic solution for an inclined borehole," Journal of Applied Mechanics, Mar. 1997, 64(1):32-38, 7 pages.
Dall'Acqua et al., "Burst and collapse responses of production casing in thermal applications." SPE Drilling & Completion 28.01, Mar. 2013, 93-104, 12 pages.
Deirieh et al., "Nanochemomechanical Assessment of Shale: A Coupled WDS-Indentation Analysis," Acta Geotechnica, 2012, 25 pages.
Devarapalli et al., "Micro-CT and FIB-SEM imaging and pom structure characterization of dolomite rock at multiple scales," Arabian Journal of Geosciences, Aug. 2017, 9 pages, abstract only.
Dobroskok et al., "Estimating Maximum Horizontal Stress from Multi-Arm Caliper Data in Vertical Wells in Oman," Abu Dhabi International Petroleum Exhibition & Conference, Nov. 2016, 7 pages.
Dvorkin, "Kozeny-Carman Equation Revisited," 2009, 16 pages.
Ekbote et al., "Porochemoelastic Solution for an Included Borehole in a Transversely Isotropic Formation," Journal of Engineering Mechanics, ASCE, Jul. 2006, 10 pages.
Ertas et al., "Petroleum Expulsion Part 1. Theory of Kerogen Swelling in Multicomponent Solvents," Energy & Fuels, 2006, 20: 295-300, 6 pages.
Ewy, "Shale Swelling/Shrinkage and Water Content Change due to Imposed Suction and Due to Direct Brine Contact," Acta Geotechnica, 2014, 9: 869-886, 18 pages.
Finney, "Random packings and the structure of simple liquids I. The geometry of random close packing," Proceedings of the Royal Society A, May 1970, 319: 479-493, 15 pages.
Frazer et al., "Localized Mechanical Property Assessment of SiC/SiC Composite Materials," Science Direct, Composites: Part A, 2015, 70: 93-101, 9 pages.
Gao et al., "Materials Become Insensitive to Flaws at Nanoscale: Lessons from Nature," Proceedings of the National Academy of Sciences, PNAS, May 2003, 100:10 (5597-55600), 4 pages.
Gamero, "The Contribution of Collagen Crosslinks to Bone Strength," International Bone & Mineral Society, BoneKEy Reports, Sep. 2012, 1: 182, 8 pages.
Georgi et al., "Physics and Chemistry in Nanoscale Rocks," Society of Petroleum Engineers (SPE), SPE Forum Series, Frontier of Technology, Mar. 22-26, 2015, La Jolla, California, USA, 4 pages.
Goodman, "Chapter 3: Rock Strength and Failure Criteria," in Introduction to Rock Mechanics, John Wiley & Sons, 21 pages.
Greenwood et al., "Evaluation and Application of Real-Time Image and Caliper Data as Part of a Wellbore Stability Monitoring Provision," IADC/SPE 99111, International Association of Drilling Contractors (IADC), Society of Petroleum Engineers (SPE), presented at the IADC/SPE Drilling Conference, Feb. 21-23, 2006, 12 pages.
Han et al., "Impact of Depletion on Integrity of Sand Screen in Depleted Unconsolidated Sandstone Formation," ARMA-2015-301, American Rock Mechanics Association, (ARMA), presented in the 49th US Rock Mechanics/Geomechanics Symposium. American Rock Mechanics Association, Jun.-Jul. 2015, 9 pages.
Han et al., "LBM-DEM Modeling of Fluid-Solid Interaction in Porous Media," International Journal for Numerical and Analytical Methods in Geomechanics, 2013, 37: 1391-1407, 17 pages.
Han et al., "Numerical Modeling of Elastic Hemispherical Contact for Mohr-Coulomb Type Failures in Micro-Geomaterials," Experimental Mechanics, Jun. 2017, 57: 1091-1105, 14 pages.
Hay, "Development of an Insitu Rock Shear Testing Device," Dissertation for the Degree of Doctor of Philosophy, University of Florida, Graduate School, 2007, 67 pages.
Hiramatsu et al., "Stress around a shaft or level excavated in ground with a three-dimensional stress state," Mem Fac Eng Kyotu Univ, 1962, 24:56-76, English Abstract only, 7 pages.
Hirata et al., "Estimation of Damaged Region Around a Tunnel By Compact VSP Probe Using Super Elastic Alloy," 9th IRSM Congress, International Society for Rock Mechanics, Jan. 1999, 4 pages.
Hlidek et al., "Cost Effective Monitoring and Visualization System Used for Real-Time Monitoring of Downhole Operations from the Wellhead," SPE-181688-MS, Society of Petroleum Engineers, 2016, 9 pages.
Hlidek, "Proven hydraulic fracturing field applications for real-time visualization and monitoring system," SPE-187126-MS, Society of Petroleum Engineers, Oct. 2017, 6 pages.
Hoang et al., "Correspondence Principle Between Anisotropic Poroviscoelasticity and Poroelasticity using Micromechanics and Application to Compression of Orthotropic Rectangular Strips," Journal of Applied Physics, American Institute of Physics, Aug. 2012, 112:044907, 16 pages.
Hornby et al., "Anisotropic Effective-Medium Modeling of the Elastic Properties of Shales," Geophysics, Oct. 1994, 59:10 (1570-1583), 14 pages.
Hosemann et al., "An Exploratory Study to Determine Applicability of Nano-Hardness and Micro-compression Measurements for Yield Stress Estimation," Science Direct, Journal of Nuclear Materials, 2008, 375: 135-143, 9 pages.
Hosemann et al., "Mechanical Characteristics of SiC Coating Layer in TRISO Fuel Particles," Journal of Nuclear Materials, 2013, 442: 133-142, 10 pages.
Huang et al., "A theoretical study of the critical external pressure for casing collapse" Journal of Natural Gas Science and Engineering, Nov. 2015, 27:1 (1-8), 8 pages.
Huang et al., "Collapse strength analysis of casing design using finite element method," International Journal of Pressure Vessels and Piping 2000, 77:359-367, 8 pages.
Huang et al., "Pressuremeter Tests In Poorly Cemented Weak Rocks," Rock Mechanics for Industry, Amadei, Kranz, Scott and Smealtie (eds), 1999, 6 pages.
Hull et al., "Oxidative Kerogen Degradation: A Potential Approach to Hydraulic Fracturing in Unconventionals," Energy Fuels 2019, 33:6 (4758-4766), 9 pages.
Inaba et al., "Static Rock Splitter Using Shape Memory Alloy as Pressure Source," Journal of Mining and Materials Processing Institute of Japan, Jan. 1991, 4 pages.
insulationexpress.co.uk [online], "Soundproofing Walls," available on or before Oct. 30, 2020, via Internet Archive: Wayback Machine URL <http://web.archive.org/web/20201030172854/https://www.insulationexpress.co.uk/guides/acoustic-insulation/how-to-soundproof-a-wall/>, retrieved on Oct. 19, 2021, URL <https://www.insulationexpress.co.uk/blog/soundproofing-walls.html>, 7 pages.
Iqbal et al., "In situ micro-cantilver tests to study fracture properties of NiAl single crystals," Acta Materialia, Feb. 2012, 60:3 (1193-1200), 8 pages.
Itasca, "Fast Lagrangian Analysis of Continua," Version 7.0. Minneapolis, Minnesota, 2011, 22 pages.
Itascag.com [online], "Three-dimensional Fast Lagrangian Analysis of Continua (FLAC3D)," available on or before 2012, [retrieved on Jun. 7, 2018], retrieved from URL: <https://www.itascacg.com/software/flac3d>, 4 pages.

(56) References Cited

OTHER PUBLICATIONS

Iyengar et al., "Analysis of Crack Propagation in Strain-Softening Beams," Engineering Fracture Mechanics, 2002, 69: 761-778, 18 pages.
Jose et al., "Continuous multi cycle nanoindentation studies on compositionally graded $Ti_{1-X}AI_XN$ multilayer thin films," Materials Science and Engineering: A, Elsevier, Apr. 20, 2011, 528:21 (6438-6444), 7 pages.
Kelemen et al., "Petroleum Expulsion Part 2. Organic Matter Type and Maturity Effects on Kerogen Swelling by Solvents and Thermodynamic Parameters for Kerogen from Regular Solution Theory," Energy & Fuels, 2006, 20: 301-308, 8 pages.
Kolymbas, "Kinematics of Shear Bands," Acta Geotechnica, 2009, 4: 315-318, 4 pages.
Lam et al., "Experiments and Theory in Strain Gradient Elasticity," Journal of Mechanics and Physics Of Solids, 2003, 51: 1477-1508, 32 pages.
Larsen et al., "Changes in the Cross-Link Density of Paris Basin Toarcian Kerogen During Maturation," Organic Geochemistiy, 2002, 33:1143-1152, 10 pages.
Lee et al., "An Analytical Study on Casing Design for Stabilization of Geothermal Well," Korean J. Air-Conditioning and Ref. Eng., 2012, 11:24, 16 pages.
L'homme, "Initiation of hydraulic fractures in natural sandstones," Master of Science in Geomechanics, University of Minnesota, PhD dissertation, Delft University of Technology, Delft, 2005, 281 pages.
Li et al., "Maximum Horizontal Stress and Wellbore Stability While Drilling: Modeling and Case Study," SPE Latin American & Caribbean Petroleum Engineering Conference, Dec. 2010, 11 pages.
Li et al., "Mechanical Characterization of Micro/Nanoscale Structures for MEMS/NEMS Applications using Nanoindentation Techniques," Science Direct, Ultramicroscopy, 2003, 97:481-494, 14 pages.
Liu, "Dimension effect on mechanical behavior of silicon microcantilver beams," Measurement, Oct. 2008, 41:8 (885-895), 11 pages.
Liu, "Micro-cantilver Testing to Evaluate the Mechanical Properties of Thermal Barrier Coatings," 19th European Conference on Fracture (ECF19): Fracture Mechanics for Durability, Reliability and Safety; Conference Proceedings held Aug. 26-31, 2012, Kazan, Russia, 7 pages.
Mahabadi et al., "A novel approach for micro-scale characterization and modeling of geomaterials incorporating actual material heterogeneity," Geophysical Research Letters, American Geophysical Union, Jan. 1, 2012, 39: L01303, 6 pages.
Mahabadi et al., "Development of a new fully-parallel finite-discrete element code: Irazu," ARMA-2016-516, American Rock Mechanics Association (ARMA), presented at the 50th US Rock Mechanics/Geomechanics Symposium, Jun. 26-29, 2016, 9 pages.
Mahmoud et al., "Removal of Pyrite and Different Types of Iron Sulfide Scales in Oil and Gas Wells without H2S Generation," IPTC-18279-MS, International Petroleum Technology Conference (IPTC), presented at the International Petroleum Technology Conference, Doha, Qatar, Dec. 6-9, 2015, 8 pages.
Maio et al., "Measuring Fracture Toughness of Coatings using Focused-ion-beam-machined Microbeams," Journal of Materials Research, Feb. 2005, 20:2, 4 pages.
Medlin et al., "Laboratory investigation of Fracture Initiation and Orientation," SPE-6087-PA, Society of Petroleum Engineers (SPE), Society of Petroleum Engineers Journal, Apr. 1976, 19:02, 16 pages.
Mitchell et al., "Chapter 7—Casing and Tubing Design," Properties of Casing and Tubing, Petroleum well construction, 1998, 40 pages.
Mohammed et al., "Casing structural integrity and failure modes in a range of well types—A review," Journal of Natural Gas Science and Engineering, 2019, 68: 102898, 25 pages.
Money, "Oklahoma eyes earthquakes tied to well completions," The Oklahoman, Dec. 24, 2017, 2 pages.
Najm et al., "Comparison and Applications of Three Different Maximum Horizontal Stress Predictions," SPWLA 61st Annual Logging Symposium, Jun. 2020, 11 pages.
Nwonodi et al., "A Scheme for Estimating the Magnitude of the Maximum Horizontal Stress for Geomechanical Studies," Nigeria Annual International Conference and Exhibition, Aug. 2020.
Okiongbo et al., "Changes in Type II Kerogen Density as a Function of Maturity: Evidence from the Kimmeridge Clay Formation," Energy Fuels, 2005, 19: 2495-2499, 5 pages.
Oliver, "An Improved Technique for Determining Hardness and Elastic Modulus using Load and Displacement Sensing Indentation Experiments," Journal of Materials Research, Jun. 1992, 7:6, 20 pages.
Ortega et al., "The Effect of Particle Shape and Grain-Scale Properties of Shale: A Micromechanics Approach," International Journal for Numerical and Analytical Methods in Geomechanics, 2010, 34: 1124-1156, 33 pages.
Ortega et al., "The Effect of the Nanogranular Nature of Shale on their Poroelastic Behavior," Acta Geotechnica, 2007, 2: 155-182, 28 pages.
Ortega et al., "The Nanogranular Acoustic Signature of Shale," Geophysics, May-Jun. 2009, 74:3 (D65-D84), 20 pages.
Passey et al., "From Oil-Prone Source Rock to Gas-Producing Shale Reservoir—Geologic and Petrophysical Characterization of Unconventional Shale-Gas Reservoirs," SPE-131350, Society of Petroleum Engineers (SPE), presented at the CPS/SPE International Oil & Gas Conference and Exhibition, Beijing, China, Jun. 8-10, 2010, 29 pages.
Pittman, "Investigation of Abrasive-Laden-Fluid Method for Perforation and Fracture Initiation," SPE 1607-G, Society of Petroleum Engineers (SPE), presented at the 31st Annual California Regional Fall Meeting of SPE, Oct. 20-21, 1960, Journal of Petroleum Technology, May 1961, 13:5 (489-495), 7 pages.
Podio et al., "Dynamic Properties of Dry and Water-Saturated Green River Shale under Stress," SPE 1825, Society of Petroleum Engineers (SPE), presented at SPE 42nd Annual Fall Meeting, Oct. 1-4, 1967, Society of Petroleum Engineers Journal, Jun. 1968, 16 pages.
Poon et al., "An Analysis of Nanoindentation in Linearly Elastic Solids," International Journal of Solids and Structures, Dec. 2008, 45:24 (6018-6033), 16 pages.
Rahim, "Hydraulic Fracturing—2020," Journal of Petroleum Technology, cover page, Mar. 2020, 6 pages.
Richard et al., "Slow Relaxation and Compaction of Granular Systems," Nature Materials, Feb. 2005, 4, 8 pages.
Rodoplu et al., "Evolution of Limited Entry Multi Stage Stimulation Completion Technology for Improved Acid Stimulation in Tight Carbonate Reservoirs," SPE-192256-MS, Society of Petroleum Engineers, 2018, 18 pages.
seismos.com [online], "Real-time Acoustic MWF™ Solutions (Measurements While Fracing)," available on or before 2020, retrieved on Oct. 19, 2021, retrieved from URL <https://www.seismos.com/>.
Serdyukov et al., "Hydraulic Fracturing for In Situ Stress Measurement," Journal of Mining Science, 2016, 52:6 (1031-1038), 8 pages.
Shi et al., "Research and Application of Drilling Technology of Extended-reach Horizontally-intersected Well Used to Extract Coalbed Methane," 2011 Xi'an International Conference on Fine Geological Exploration and Groundwater & Gas Hazards Control in Coal Mines, Procedia Earth and Panetaiy Science, Dec. 2011, 3: 446-454, 9 pages.
Shin et al., "Development and Testing of Microcompression for Post Irradiation Characterization of ODS Steels," Journal of Nuclear Materials, 2014, 444: 43-48, 6 pages.
siemens-energy.com [online], "Siemens Energy Electrical and Mechanical Solutions (SEAM) for Pressure Pumping and Mobile Oilfield Applications," available on or before Sep. 19, 2020, via Internet Archive: Wayback Machine URL <http://web.archive.org/web/20200919133308/https://www.siemens-energy.com/global/cn/offerings/industrial-applications/oil-gas/upstream/unconventional-resources/seam.html>, retrieved on Oct. 19, 2021, URL <https://www.siemens-energy.com/global/cn/offerings/industrial-applications/oil-gas/upstream/unconventional-resources/seam.html>.
Sierra et al., "Woodford Shale Mechanical Properties and the Impacts of Lithofacies," ARMA 10-461, American Rock Mechanics

(56) References Cited

OTHER PUBLICATIONS

Association (ARMA), presented at the 44th US Rock Mechanics Symposium and 5th US-Canada Rock mechanics Symposium, Jun. 27-30, 2010, 10 pages.
Slatt et al., "Merging Sequence Stratigraphy and Geomechanics for Unconventional Gas Shales," The Leading Edge, Special Section: Shales, Mar. 2011, 8 pages.
Slatt et al., "Outcrop/Behind Outcrop (Quarry), Multiscale Characterization of the Woodford Gas Shale," Chapter 12 in Shale-Reservoirs—Giant Resources for the 21st Century: AAPG Memoir, 2011, 97: 1-21, 22 pages.
Sone et al.," Mechanical Properties of Shale-Gas Reservoir Rocks—Part 1: Static and Dynamic Elastic Properties and Anisotropy," Geophysics, Sep.-Oct. 2013, 78:5 (D381-D392), 12 pages.
Sone et al., "Mechanical Properties of Shale-Gas Reservoir Rocks—Part 2: Ductile Creep, Brittle Strength, and their Relation to the Elastic Modulus," Geophysics, Sep.-Oct. 2013, 78:5 (D393-D402), 10 pages.
soundproofingstore.co.uk [online], "ReductoClip™ System," available on or before 2020, retrieved on Oct. 19, 2021, retrieved from URL <https://www.soundproofingstore.co.uk/reducto-clip-system>.
soundproofingstore.co.uk [online], Ian Baker, "What is the best sound proof acoustic insulation?," Oct. 4, 2019, retrieved on Feb. 24, 2022, retrieved from URL <https://www.soundproofingstore.co.uk/soundproofing-insulation>, 13 pages.
Tranggono "Wellbore Collapse Failure Criteria and Drilling Optimization", University of Stavanger, 2019, pp. 1-132.
Ulm et al., "Material Invariant Poromechanics Properties of Shales," Poromechanics III: Biot Centennial, Proceedings of the 3rd Biot Conference on Poromechanics, 2005, 8 pages.
Ulm et al., "The Nanogranular Nature of Shale," Acta Geotechnica, 2006, 12 pages.
Vanlandingham, "Review of Instrumented Indentation," Journal of Research of the National Institute of Standards and Technology, Jul.-Aug. 2003, 108:4 (249-265), 17 pages.
Vernik et al., "Ultrasonic Velocity and Anisotropy of Hydrocarbon Source Rocks," Geophysics, May 1992, 57:5 (727-735), 9 pages.
Wang et al., "A Numerical Study of Factors Affecting the Characterization of Nanoindentation on Silicon," Materials Science and Engineering: A, Feb. 25, 2007, 447:1 (244-253), 10 pages.
Wang et al., "Iron Sulfide Scale Dissolvers: How Effective Are They?" SPE-168063-MS, Society of Petroleum Engineers (SPE), presented at the SPE Saudi Arabia section Annual Technical Symposium and Exhibition, Khobar, Saudi Arabia, May 19-22, 2013, 22 pages.
Wenk et al., "Preferred Orientation and Elastic Anisotropy of Illite-Rich Shale," Geophysics, Mar.-Apr. 2007, 72:2 (E69-E75), 7 pages.
Wilson et al., "Fracture testing of bulk silicon microcantilever beams subjected to a side load," Journal of Microelectromechanical Systems, Sep. 1996, 5:3, 9 pages.
Winkler et al., "Effects of borehole stress concentrations on dipole anisotropy measurements," Geophysics, Jan. 1998, 63:1 (11-17), 7 pages.
Wurster et al., "Characterization of the fracture toughness of microsized tungsten single crystal notched specimens," Philosophical Magazine, May 2012, 92:14, 23 pages.
Xi et al., "Uncertainty Analysis Method for Intersecting Process of U-Shaped Horizontal Wells," Arabian Journal for Science and Engineering, 40:2 (615-625), Feb. 2015, 12 pages.
Zeszotarski et al., "Imaging and Mechanical Property Measurements of Kerogen via Nanoindentation," Geochimica et Cosmochimica Acta, 2004, 68:20, 7 pages.
Zoback, "Reservoir geomechanics," Cambridge University Press, 2010, Chapter 6: 196-197, 13 pages.
Zwanenburg et al., "Well Abandonment: Abrasive Jetting to Access a Poorly Cemented Annulus and Placing a Sealant," SPE-159216-MS, Society of Petroleum Engineers (SPE), presented at the SPE Annual Technical Conference and Exhibition, Oct. 8-10, 2012, 11 pages.

* cited by examiner

WELLHEAD ACOUSTIC INSULATION TO MONITOR HYDRAULIC FRACTURING

TECHNICAL FIELD

This disclosure relates to wellbore operations, for example, hydraulic fracturing within wellbores.

BACKGROUND

Hydraulic fracturing is a stimulation treatment routinely performed on oil and gas wells. Hydraulic fracturing fluids are pumped into a hydrocarbon-bearing formation causing fractures to open in the subsurface formation. Proppants, such as grains of sand of a particular size, may be mixed with the treatment fluid to keep the fracture open when the treatment is complete. Hydraulic fracturing operations involve activation of sleeves disposed within the wellbore to permit flow of the hydraulic fracturing fluids onto the formation. The operations, including the opening of the sleeves, can be monitored to ensure efficient hydraulic fracturing.

SUMMARY

This disclosure describes technologies relating to wellhead acoustic insulation to monitor hydraulic fracturing.

Certain aspects of the subject matter described in this disclosure can be implemented as a method. An acoustic insulation tool acoustically insulates a wellhead installed at a surface of a wellbore. Multiple acoustic sensors attached to the wellhead sense acoustic signals generated responsive to operation of hydraulic fracturing components. The components perform hydraulic fracturing operations within the wellbore. The acoustic insulation tool acoustically insulates the wellhead from acoustic signals generated by sources other than the hydraulic fracturing components. The multiple acoustic sensors transmit the sensed acoustic signals to a computer system. Using the received acoustic signals, the computer system monitors the hydraulic fracturing operations performed within the wellbore.

An aspect combinable with any other aspect includes the following features. To acoustically insulate the wellhead, a wellhead flange of the wellhead is acoustically insulated.

An aspect combinable with any other aspect includes the following features. To acoustically insulate the wellhead flange, an acoustic insulation tool that includes acoustic insulation material is wrapped around an entirety of the wellhead flange.

An aspect combinable with any other aspect includes the following features. To acoustically insulate the wellhead flange, an acoustic insulation box that includes acoustic insulation material is placed around the wellhead that has the acoustic insulation tool wrapped around the entirety of the wellhead flange.

An aspect combinable with any other aspect includes the following features. The hydraulic fracturing components include a hydraulic fracturing sleeve. The operation of the hydraulic fracturing components includes activation of the hydraulic fracturing sleeve. The activation of the hydraulic fracturing sleeve generates the acoustic signals.

An aspect combinable with any other aspect includes the following features. The sources other than the hydraulic fracturing components that perform the hydraulic fracturing operations within the wellbore include surface equipment. To acoustically insulate the wellhead installed at the surface of the wellbore, an interference of acoustic signals generated by the surface equipment on the acoustic signals generated by the activation of the hydraulic fracturing sleeve is minimized.

An aspect combinable with any other aspect includes the following features. The acoustic insulation tool is formed by layering a first insulation material over a second insulation material.

An aspect combinable with any other aspect includes the following features. A gap is left between the first insulation material and the second insulation material when forming the acoustic insulation tool.

Certain aspects of the subject matter described here can be implemented as a system. The system includes an acoustic insulation tool that can be attached to a wellhead installed at a surface of a wellbore. The acoustic insulation tool is configured to acoustically insulate the wellhead from acoustic signals generated by equipment on the surface of the wellbore. Multiple acoustic sensors are attached to the wellhead. Each acoustic signal can sense acoustic signals generated by operation of hydraulic fracturing components that perform hydraulic fracturing operations within the wellbore. The acoustic insulation tool is positioned relative to the multiple acoustic sensors to filter the acoustic signals generated by the equipment on the surface of the wellbore from being sensed by the multiple acoustic sensors. The system includes a computer system connected to the multiple acoustic sensors. The computer system includes one or more processors and a computer-readable medium storing instructions executable by the one or more processors to perform operations. The operations include receiving, from the multiple acoustic sensors, the acoustic signals generated by the operation of the hydraulic fracturing components that perform the hydraulic fracturing operations within the wellbore. The received acoustic signals are insulated from the acoustic signals generated by the equipment on the surface of the wellbore. The operations include monitoring the hydraulic fracturing operations performed within the wellbore based on the received acoustic signals.

An aspect combinable with any other aspect includes the following features. The acoustic insulation tool can be attached to a wellhead flange of the wellhead.

An aspect combinable with any other aspect includes the following features. The acoustic insulation tool includes an acoustic insulation belt that includes acoustic insulation material that can be wrapped around an entirety of the wellhead flange.

An aspect combinable with any other aspect includes the following features. The multiple acoustic sensors are attached to the wellhead flange. The acoustic insulation belt can be wrapped over the multiple acoustic sensors.

An aspect combinable with any other aspect includes the following features. The acoustic insulation tool is a first acoustic insulation tool. The system includes a second acoustic insulation tool that can acoustically insulate the first acoustic insulation tool and the wellhead flange.

An aspect combinable with any other aspect includes the following features. The second acoustic insulation tool includes an acoustic insulation box that includes acoustic insulation material. The acoustic insulation box is positioned over the wellhead to cover the wellhead flange and the first acoustic insulation tool.

An aspect combinable with any other aspect includes the following features. The acoustic insulation box includes a layer of a first insulation material positioned over a layer of a second insulation material.

An aspect combinable with any other aspect includes the following features. The acoustic insulation box includes a gap between the layer of the first insulation material and the layer of the second insulation material.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
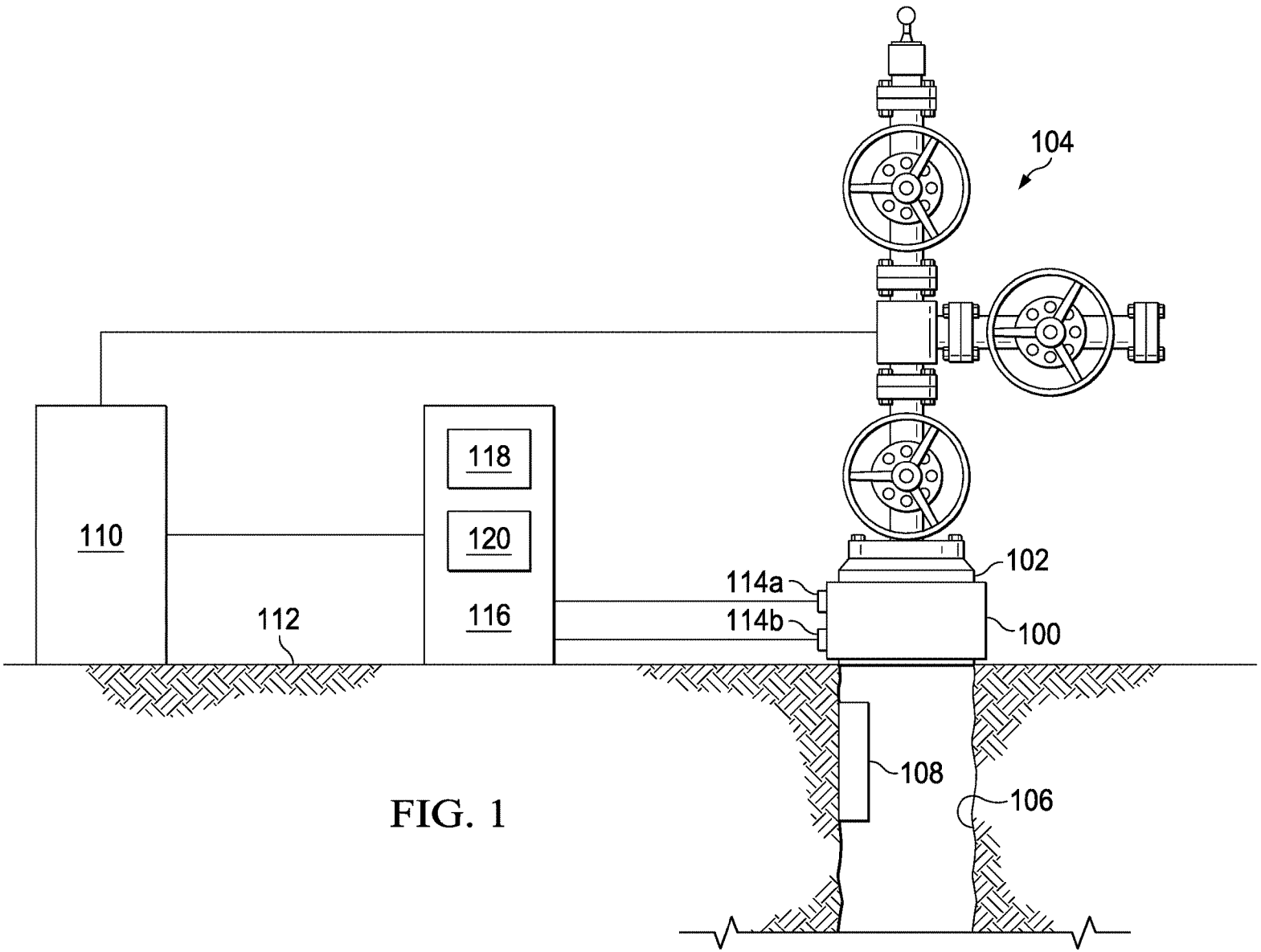
FIG. 1 is schematic diagram of an example of an acoustic insulation tool wrapped around a wellhead flange of a wellhead of a wellbore.

Hydraulic fracturing operations are performed using equipment disposed both on a surface of the wellbore and within the wellbore. Fracturing operations within the wellbore can be monitored by recording and analyzing acoustic signals such as those generated by the propagation of hydraulic fractures during the fracturing operations. Ambient noise by equipment disposed on the surface of the wellbore, for example, fracturing pumps, and/or noise by other surroundings at the surface of the wellbore can interfere with the low-amplitude acoustic signals generated within the wellbore. This disclosure describes techniques to minimize or eliminate the effect of such ambient noise on the acoustic signals generated within the wellbore.

The techniques described in this disclosure can be implemented to monitor hydraulic fracturing operations, for example, monitor the activation of hydraulic sleeves disposed within the wellbore using acoustic signals generated by such activation. In some implementations, a wellhead disposed at a surface of the wellbore is acoustically insulated. Acoustic sensors are attached to the wellhead, and acoustic signals sensed by the sensors are collected by a processor. In particular, when a hydraulic sleeve within the wellbore is activated, the activation generates a high-amplitude signal that can be detected by the sensors on the wellhead. The acoustic insulation filters out the ambient noise such that the acoustic signal received by the processor represents the hydraulic sleeve activation, not the ambient noise.

In some implementations, a first acoustic insulation tool, namely an acoustic insulation belt can be wrapped around a wellhead flange to insulate the wellhead. In some implementations, a second acoustic insulation tool, namely an acoustic insulation box, can be placed around the wellhead. Implementations in which the first acoustic insulation tool and the second acoustic insulation tool are used together are also described below. A data acquisition unit/processor (for example, a computer system) can receive the signals sensed by the acoustic sensors (for example, pressure transducers) and can monitor hydraulic sleeve activation based on the acoustic signals.

By acoustically insulating the wellhead as described in this disclosure, ambient noise by frac pumps and other surroundings at the surface can be reduced. Consequently, the techniques described here can enable monitoring and recording low-amplitude acoustic signals such as those generated by the propagation of hydraulic fractures (close to the wellbore and deep in the formation) during hydraulic fracturing operations. The techniques described here are applicable to both openhole multi-stage fracturing (MSF) completions as well as plug-and-perf cemented completions. The techniques described here can also minimize computational post-processing and filtering of acoustic signals by implementing physical filters, namely, the acoustic insulation tools. The techniques described here can also be used to detect wellbore events in plug-and-perf completions such as confirmation of plug settings.

FIG. 1 is schematic diagram of an example of an acoustic insulation tool 100 wrapped around a wellhead flange 102 of a wellhead 104 of a wellbore 106. The wellbore 106 can be formed through a subterranean zone (not labeled). The subterranean zone can include a formation, a portion of a formation, or multiple formations. A portion of the subterranean zone through which the wellbore 106 is formed can be hydraulically fractured using hydraulic fracturing components, for example, a hydraulic fracturing sleeve 108 disposed within the wellbore 106. The hydraulic fracturing components disposed within the wellbore 106 can be operated by hydraulic fracturing equipment 110 disposed at a surface 112.

In some implementations, multiple acoustic sensors (for example, acoustic sensor 114*a*, acoustic sensor 114*b* or more or fewer acoustic sensors) are attached to the wellhead 104. Each acoustic sensor can be a high-frequency acoustic sensor or pressure transducer or both that can record surface acoustic signals and surface pressures at a high frequency, for example, one reading every $10{,}000_{th}$ of a second. The number of acoustic sensors attached to the wellhead can depend on several factors. The factors include space available to attach the acoustic sensors, available computational processing power to process acoustic signals sensed by the acoustic sensors, amplitude of the acoustic signal generated during operation of the hydraulic fracturing components disposed within the wellbore 106, a depth at which such components are disposed within the wellbore 106, other factors, or any combination of them. For example, the wellhead 104 can include the wellhead flange 100 at a base of the wellhead 104 such that the wellhead flange 100 directly and immediately contacts the surface 112. The acoustic sensors can be attached to the wellhead flange 100 at multiple locations on a circumference of the flange 100. Alternatively or in addition, the sensors (or additional sensors) can be attached to any component of the wellhead including components above the flange 100. In some implementations, each acoustic sensor can be made of a material that is a good conductor of sound and can be constructed in a manner that allows the acoustic sensor to be easily attached, i.e., connected to, the flange 100. For example, each acoustic sensor can be constructed like a clip that can be clipped onto the flange 100.

In some implementations, the acoustic isolation tool 100 is attached to the wellhead 104 at the surface 112 of the wellbore 106. For example, the acoustic isolation tool 100 is a belt made of acoustic insulation material having a width at least equal to a width of the wellhead flange 100 and a length at least equal to a circumference of the wellhead flange 100. Examples of acoustic insulation material into acoustic mineral wool, acoustic plasterboard, mass-loaded vinyl, closed-cell phone or any material with soundproofing capabilities. A thickness of the acoustic isolation tool 100 can be selected based on an expected amount of ambient noise at the surface 112 or a required amount of acoustic insulation or a combination of the two.

In some implementations, the acoustic isolation tool 100 can be wrapped over the multiple acoustic sensors such that the sensors are sandwiched between the acoustic isolation tool 100 and the flange 100. In such an arrangement, the acoustic isolation tool 100 acoustically insulates the wellhead 102, specifically the portion of the wellhead 102 that is connected to the multiple acoustic sensors, from ambient noise or other acoustic signals generated by equipment (for example, the hydraulic fracturing equipment 110) on the surface 112 of the wellbore 106. By doing so, the acoustic insulation tool 100 filters the acoustic signal generated by the equipment on the surface 112 from being sensed by the multiple acoustic sensors. Consequently, the only (or a majority of) acoustic signals sensed by the acoustic sensors originate from within the wellbore 106 and are due to operation of the hydraulic fracturing components within the wellbore 106. In some implementations, a longer length or width of the acoustic insulation tool 100 can be implemented to wrap an entirety of the wellhead 104 to further acoustically insulate the wellhead 104. In some implementations, acoustic sensors can be attached to portions of the wellhead 104 other than or in addition to the flange 102. In such implementations, the acoustic insulation tool 100 can be wrapped around any portion of the wellhead 104 to which acoustic sensors are attached.

In some implementations, each acoustic sensor is a pressure transducer that can sense pressure-induced sound and convert the sound into a digital signal. Each acoustic sensor is connected to a computer system 116 through wired or wireless connections or a combination of them to transfer the digital signal from each sensor to the computer system 116. The computer system 116 includes one or more processors (for example, a processor 118) and a computer-readable medium 120 (for example, a non-transitory computer-readable medium) storing computer instructions executable by the one or more processors to perform operations described in this disclosure.

In some implementations, the computer system 116 receives, from the multiple acoustic sensors, the acoustic signals generated by the operation of the hydraulic fracturing components (for example, the hydraulic sleeve 108) that perform the hydraulic fracturing operations within the wellbore 106. As described above, the received acoustic signals are insulated from the acoustic signal generated by the equipment on the surface of the wellbore 106. The computer system 116 monitors the hydraulic fracturing operations performed within the wellbore 106 based on the received acoustic signals.

In some implementations, the computer system 116 can deploy real-time visualization to monitor the hydraulic fracturing operations. To do so, the computer system 116 can receive, as input, data from two sources—the data from the acoustic/pressure sensors and real-time hydraulic fracturing data received from the hydraulic fracturing equipment 110, specifically from a fracking computer included in the hydraulic fracturing equipment 110. The computer system 116 can digitally integrate the data from the two sources and, in real time, generate a visualization, which the computer system 116 can display on a monitor (not shown). Such a visualization allows an operator of the hydraulic fracturing equipment 110 to identify characteristics sounds that are related to certain hydraulic fracturing operations such as an actuation ball being dropped into the wellbore 106 from the surface 112, landing on a ball seat disposed within the wellbore 106, functioning a downhole port and subsequently activating the hydraulic sleeve 108. By implementing the acoustic insulation tool 100, an effect of ambient noise on the data sensed by the acoustic sensors is minimized or eliminated. Consequently, the monitoring operations in prevented by the computer system 116 are improved.

Figure 2A:
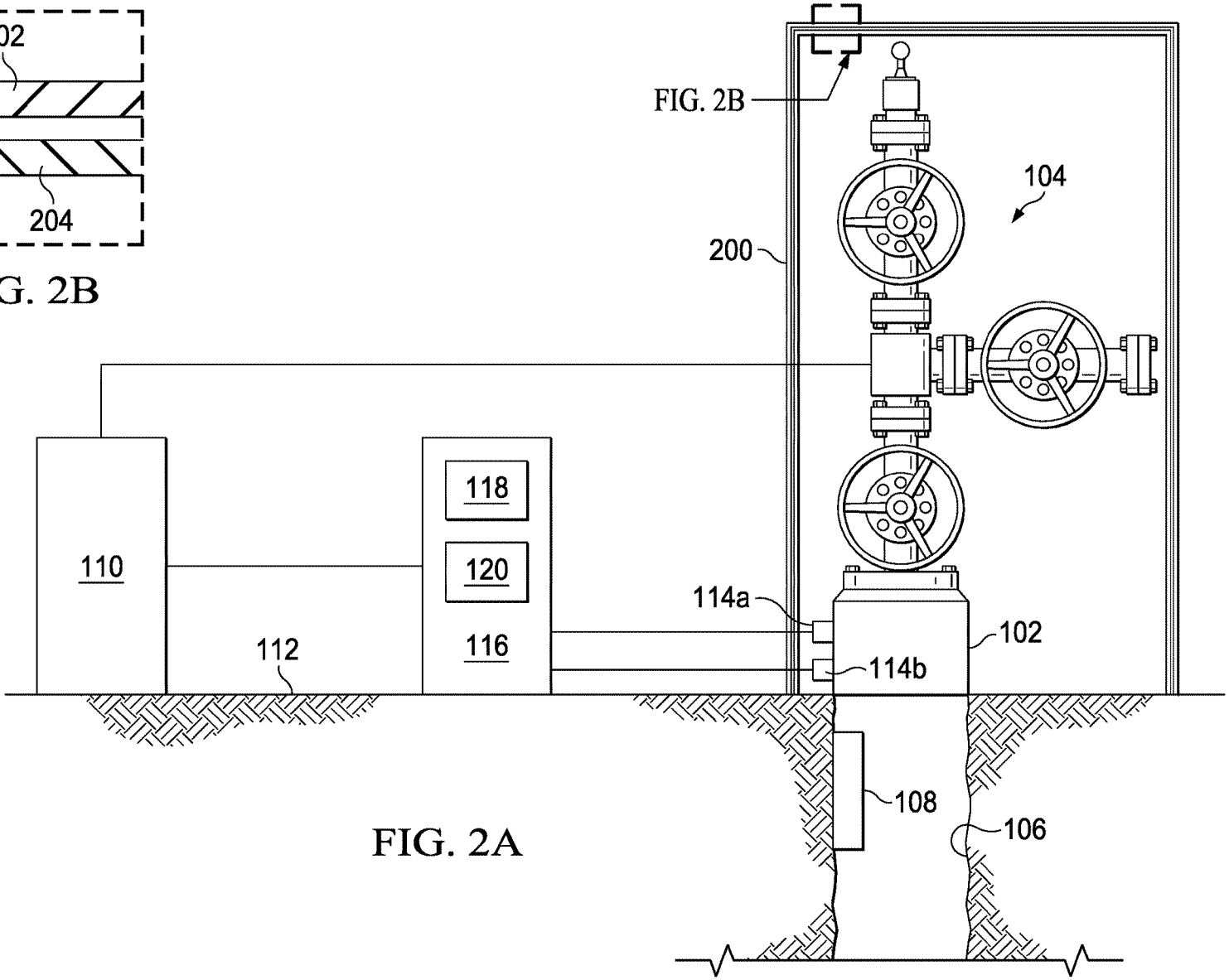
FIG. 2A is a schematic diagram of an example of an acoustic insulation tool covering a wellhead of a wellbore.
Figure 2B:
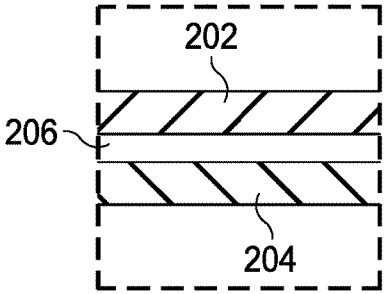
FIG. 2B is a schematic diagram of an example of a portion of the acoustic insulation tool of FIG. 2A.

FIG. 2A is a schematic diagram of an example of an acoustic insulation tool 200 covering the wellhead 104 of the wellbore 106. In some implementations, instead of the acoustic insulation tool 100 (i.e., the acoustic belt), another acoustic insulation tool 200 can be used to perform the same function as the acoustic insulation tool 100. For example, the acoustic insulation tool 200 can be an acoustic insulation box. The acoustic insulation box can be dimensioned to be positioned over the wellhead 104 to cover the wellhead 104 and the multiple acoustic sensors attached to the wellhead 104. The acoustic insulation box can be made of acoustic insulation material similar to those used to make the acoustic insulation tool 100. FIG. 2B is a schematic diagram of an example of a portion of the acoustic insulation tool 200. In some implementations, the acoustic insulation box is a cuboid with one open side to cover the wellhead 104. Each wall of the cuboid can be made with multiple layers of different insulation material positioned over each other. In some constructions, one or more or all of the walls of the cuboid can include a layer of the first insulation material 202 positioned over a layer of the second insulation material 204. In some constructions, a gap 206 can be left between the two layers 202 and 204 to create a room-within-a-room effect for improved acoustic insulation.

Figure 3:
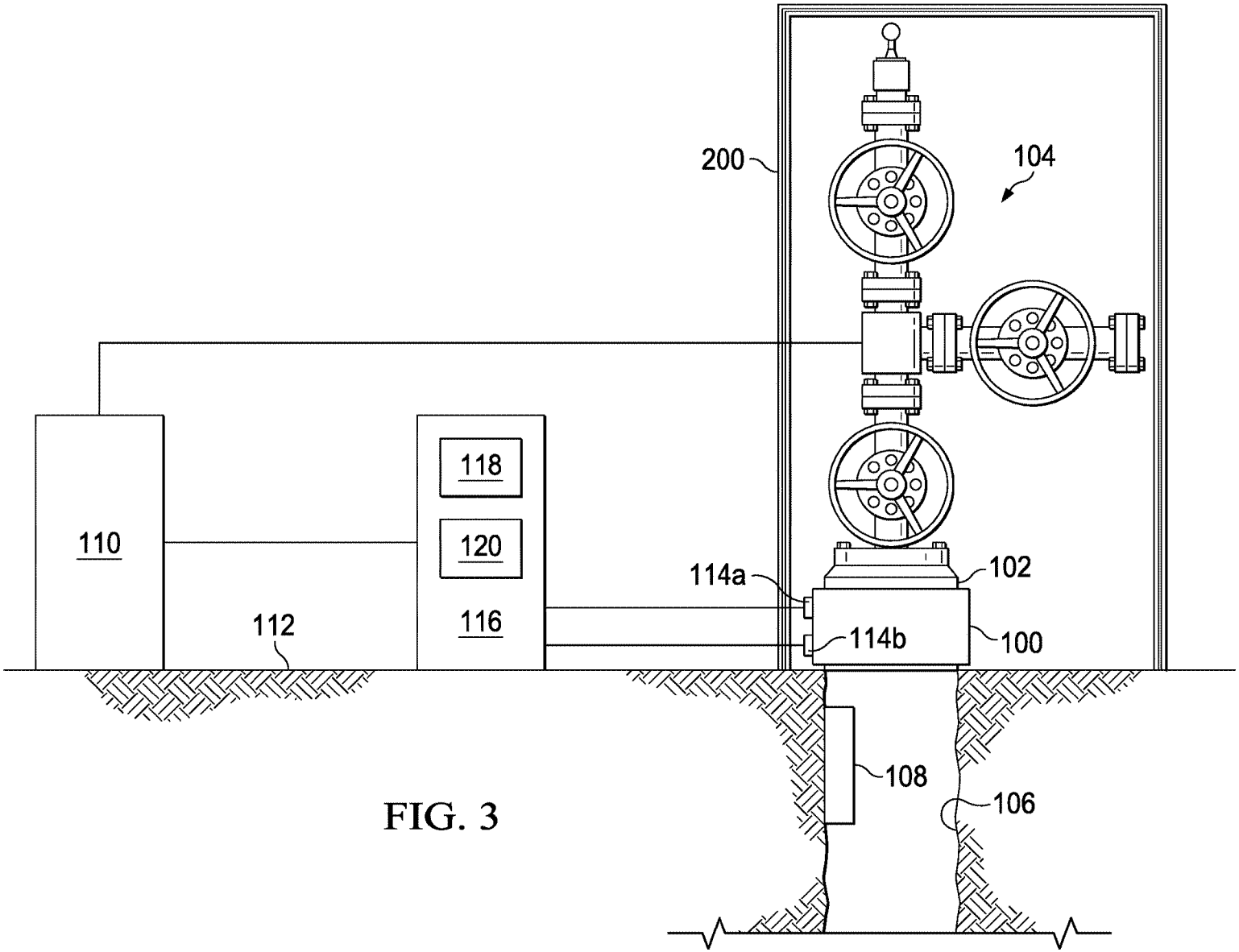
FIG. 3 is a schematic diagram of an example of an acoustic insulation tool wrapped around a wellhead flange and an acoustic insulation tool covering a wellhead of a wellbore.

FIG. 3 is a schematic diagram of an example of the acoustic insulation tool 100 wrapped around the wellhead flange 102 and the acoustic insulation tool 200 covering the wellhead 104 of the wellbore 106. By implementing both acoustic insulation tools 100, interference of ambient signals on the acoustic signals sensed by the acoustic sensors can be further decreased.

Figure 4:
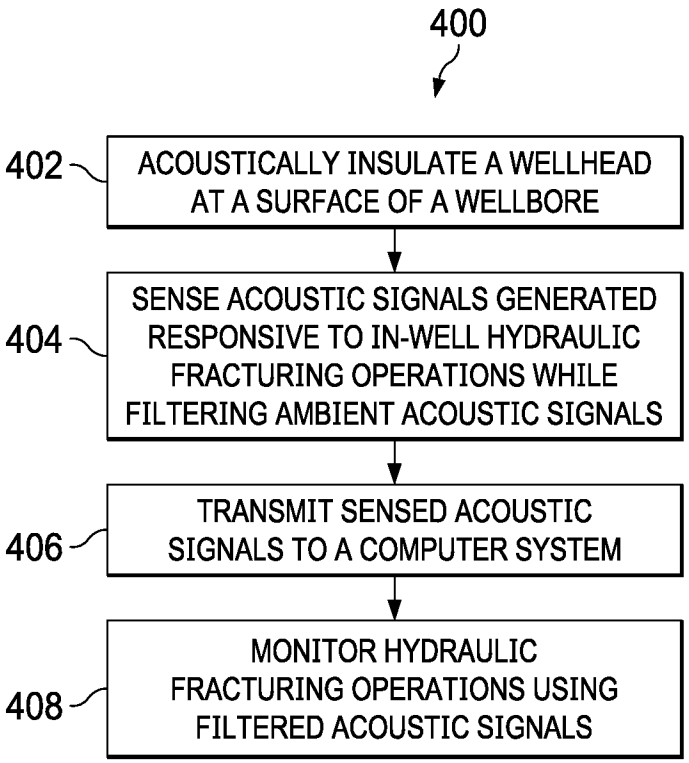
FIG. 4 is a flowchart of an example of a process of acoustically insulating a wellhead to monitor hydraulic fracturing operations.

FIG. 4 is a flowchart of an example of a process 400 of acoustically insulating a wellhead to monitor hydraulic fracturing operations. One or more steps of the process 400 can be performed by the acoustic insulation tools described above. One or more steps of the process 400 can be performed by the computer system 116 described above. At 402, an acoustic insulation tool (for example, the acoustic insulation tool 100 or the acoustic insulation tool 200 or both) acoustically insulates a wellhead (for example, the wellhead 102) installed at a surface (for example, the surface 112) of a wellbore (for example, the wellbore 106). At 402, multiple acoustic sensors sense acoustic signals generated responsive to operation of hydraulic fracturing components (for example, the hydraulic sleeve 108) that perform hydraulic fracturing operations within the wellbore. The acoustic insulation tool acoustically insulates the wellhead from acoustic signals generated by sources other than the hydraulic fracturing components that perform the hydraulic fracturing operations within the wellbore. For example, such sources can include the hydraulic fracturing equipment 110 disposed at the surface 112 of the wellbore 106. In the context of this disclosure, "a component disposed at the surface of the wellbore" means that the component is positioned at the surface of the wellbore at a distance from the wellhead such that noise generated by the component can affect acoustic signals sensed by the acoustic sensors described above. Thus, such components need not be directly connected to the surface, but instead can be positioned on other components, for example, platforms, that are directly connected to the surface. At 406, the multiple acoustic sensors transmit the sense acoustic signals to a computer system, for example, the computer system 116. At 408, the computer system, using the received acoustic signals, monitors the hydraulic fracturing operations performed within the wellbore. For example, the computer system 116 monitors the activation of the hydraulic sleeve 108 disposed within the wellbore 106. In some implementations, the computer system 116 deploys the real-time visualization described earlier to display an output of the monitoring to a hydraulic fracturing operator. Using the output of the computer system 116, the operator can control hydraulic fracturing operations.

In some implementations, the computer system 116 can use the acoustic signals filtered from the ambient noise using the acoustic insulation tools described above to monitor the propagation of hydraulic fracture in the subterranean zone. Because the input acoustic signals to the computer system 116 exclude (or include very minimal) ambient acoustic signals at the surface, the computer system 116 can detect fracture propagating within the wellbore 106. For example, the computer system 116 can detect a baseline acoustic signal level with an acoustic frequency within the wellbore 106 prior to commencing hydraulic fracturing operations. When the fracturing operations commence, higher frequency acoustic signals or increased overall noise within the wellbore 106 with hydraulic fracture. The computer system 116 can associate higher noise levels with larger fractures, larger generated overall fracture surface area or larger stimulated reservoir volume (SRV).

Thus, particular implementations of the subject matter have been described. Other implementations are within the scope of the following claims.

The invention claimed is:

1. A method comprising:

acoustically insulating, by an acoustic insulation tool, a wellhead installed at a surface of a wellbore;

sensing, by a plurality of acoustic sensors attached to the wellhead, acoustic signals generated responsive to operation of hydraulic fracturing components that perform hydraulic fracturing operations within the wellbore, wherein the acoustic insulation tool acoustically insulates the wellhead from acoustic signals generated by sources other than the hydraulic fracturing components that perform the hydraulic fracturing operations within the wellbore; and transmitting, by the plurality of acoustic sensors, the sensed acoustic signals to a computer system; and monitoring, by the computer system and using the received acoustic signals, the hydraulic fracturing operations performed within the wellbore.

2. The method of claim 1, wherein acoustically insulating the wellhead comprises acoustically insulating a wellhead flange of the wellhead.

3. The method of claim 2, wherein acoustically insulating the wellhead flange comprises wrapping an acoustic insulation tool comprising acoustic insulation material around an entirety of the wellhead flange.

4. The method of claim 3, wherein acoustically insulating the wellhead flange comprises placing an acoustic insulation box comprising acoustic insulation material around the wellhead having the acoustic insulation tool wrapped around the entirety of the wellhead flange.

5. The method of claim 1, wherein the hydraulic fracturing components comprise a hydraulic fracturing sleeve, wherein the operation of the hydraulic fracturing components comprises activation of the hydraulic fracturing sleeve, wherein the activation of the hydraulic fracturing sleeve generates the acoustic signals.

6. The method of claim 5, wherein the sources other than the hydraulic fracturing components that perform the hydraulic fracturing operations within the wellbore comprise surface equipment, wherein acoustically insulating the wellhead installed at the surface of the wellbore comprises minimizing an interference of acoustic signals generated by the surface equipment on the acoustic signals generated by the activation of the hydraulic fracturing sleeve.

7. The method of claim 1, further comprising forming the acoustic insulation tool by layering a first insulation material over a second insulation material.

8. The method of claim 7, further comprising leaving a gap between the first insulation material and the second insulation material when forming the acoustic insulation tool.

9. A system comprising:

an acoustic insulation tool configured to be attached to a wellhead installed at a surface of a wellbore, the acoustic insulation tool configured to acoustically insulate the wellhead from acoustic signals generated by equipment on the surface of the wellbore;

a plurality of acoustic sensors attached to the wellhead, each acoustic signal configured to sense acoustic signals generated by operation of hydraulic fracturing components that perform hydraulic fracturing operations within the wellbore, wherein the acoustic insulation tool is positioned relative to the plurality of acoustic sensors to filter the acoustic signals generated by the equipment on the surface of the wellbore from being sensed by the plurality of acoustic sensors; and a computer system connected to the plurality of acoustic sensors, the computer system comprising:

one or more processors, and a computer-readable medium storing instructions executable by the one or more processors to perform operations comprising:

receiving, from the plurality of acoustic sensors, the acoustic signals generated by the operation of the hydraulic fracturing components that perform the hydraulic fracturing operations within the wellbore, wherein the received acoustic signals are insulated from the acoustic signals generated by the equipment on the surface of the wellbore; and monitoring the hydraulic fracturing operations performed within the wellbore based on the received acoustic signals.

10. The system of claim 9, wherein the acoustic insulation tool is configured to be attached to a wellhead flange of the wellhead.

11. The system of claim 10, wherein the acoustic insulation tool comprises an acoustic insulation belt comprising acoustic insulation material and that is configured to be wrapped around an entirety of the wellhead flange.

12. The system of claim 11, wherein the plurality of acoustic sensors are attached to the wellhead flange, and wherein the acoustic insulation belt is configured to be wrapped over the plurality of acoustic sensors.

13. The system of claim 10, wherein the acoustic insulation tool is a first acoustic insulation tool, wherein the system further comprises a second acoustic insulation tool configured to acoustically insulate the first acoustic insulation tool and the wellhead flange.

14. The system of claim 13, wherein the second acoustic insulation tool comprises an acoustic insulation box comprising acoustic insulation material, wherein the acoustic insulation box is positioned over the wellhead to cover the wellhead flange and the first acoustic insulation tool.

15. The system of claim 14, wherein the acoustic insulation box comprises a layer of a first insulation material positioned over a layer of a second insulation material.

16. The system of claim 15, wherein the acoustic insulation box comprises a gap between the layer of the first insulation material and the layer of the second insulation material.

* * * * *